US006547248B1

(12) United States Patent
Tsai

(10) Patent No.: US 6,547,248 B1
(45) Date of Patent: Apr. 15, 2003

(54) COMBINATION OF BOUNCING BALL AND RACKET

(76) Inventor: Bi-Hua Tsai, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/098,086

(22) Filed: Mar. 15, 2002

(51) Int. Cl.[7] ..... A63B 67/20
(52) U.S. Cl. ..... 273/330; 473/424
(58) Field of Search ..... 473/424, 576, 473/575, 423; 273/330, 331; 446/247

(56) References Cited

U.S. PATENT DOCUMENTS 2,622,880 A * 12/1952 Walsh ..... 273/330
2,736,557 A * 2/1956 Androsiglio ..... 273/330
2,848,236 A * 8/1958 Gibson ..... 473/576
5,249,810 A * 10/1993 Cazalet ..... 273/330
5,348,307 A * 9/1994 Duggan ..... 473/507

* cited by examiner

*Primary Examiner*—Paul T. Sewell
*Assistant Examiner*—M. Chambers
(74) *Attorney, Agent, or Firm*—Charles E. Baxley

(57) ABSTRACT

A ball game set includes racket having a head and a handle. A first passage and a second passage respectively and co-axially defined through the handle and the head. The second passage is smaller than the first passage so as to form a shoulder at the conjunction of the first passage and the second passage. A hole is defined through two faces of the head and communicates with the second passage. A rod is inserted in the first passage and the second passage and has a flange. A spring is mounted to the rod and biased between the flange and the shoulder. A flexible cable connected to a bouncing ball is inserted in the hole and pressed by the rod.

2 Claims, 4 Drawing Sheets

COMBINATION OF BOUNCING BALL AND RACKET

FIELD OF THE INVENTION

The present invention relates to a racket having a flat face and a curve face, a rod biased by a spring and being inserted in the racket to secure a flexible cable which is connected to a bouncing ball.

BACKGROUND OF THE INVENTION

A conventional ball game set includes a bouncing ball and a racket which generally includes a head and a handle, and a flexible cable is connected to the head with a bouncing ball connected to the flexible cable. The head has two flat faces so as to hit the bouncing ball which is then pulled back and the user may hit the bounding ball again. This is a convenient tool for a player to practice how to response a ball coming toward. However, the flat face can only hit the bouncing ball along a regular orbit which could be boring for the player who wants to try to response different types of coming balls.

SUMMARY OF THE INVENTION

In accordance with one aspect of the present invention, there is provided a ball game set which is comprises a racket having a head and a handle which is connected to the head. A first passage is defined through the handle and a second passage co-axially defined in the head and communicates with the first passage. The second passage is smaller than the first passage so as to form a shoulder at the conjunction of the first passage and the second passage. A threaded inner periphery is defined at a distal end of the handle in the first passage. A hole is defined through two faces of the head and communicates with the second passage.

A rod is inserted in the first passage and the second passage. A flange extends radially outward from the rod and a spring is mounted to the rod and biased between the flange and the shoulder. An end cap is engaged with the threaded inner periphery and secured to an end of the rod.

A flexible cable has a first end thereof inserted in the hole and being positioned by the rod. A bouncing ball is connected to a second end of the flexible cable.

The primary object of the present invention is to provide a racket that is easily to replace the flexible cable and has a curve face to response the ball.

The present invention will become more obvious from the following description when taken in connection with the accompanying drawings which show, for purposes of illustration only, a preferred embodiment in accableance with the present invention.

DETAILED DESCRIPTION OF THE PREFERRED EMBODIMENT

Figure 1:
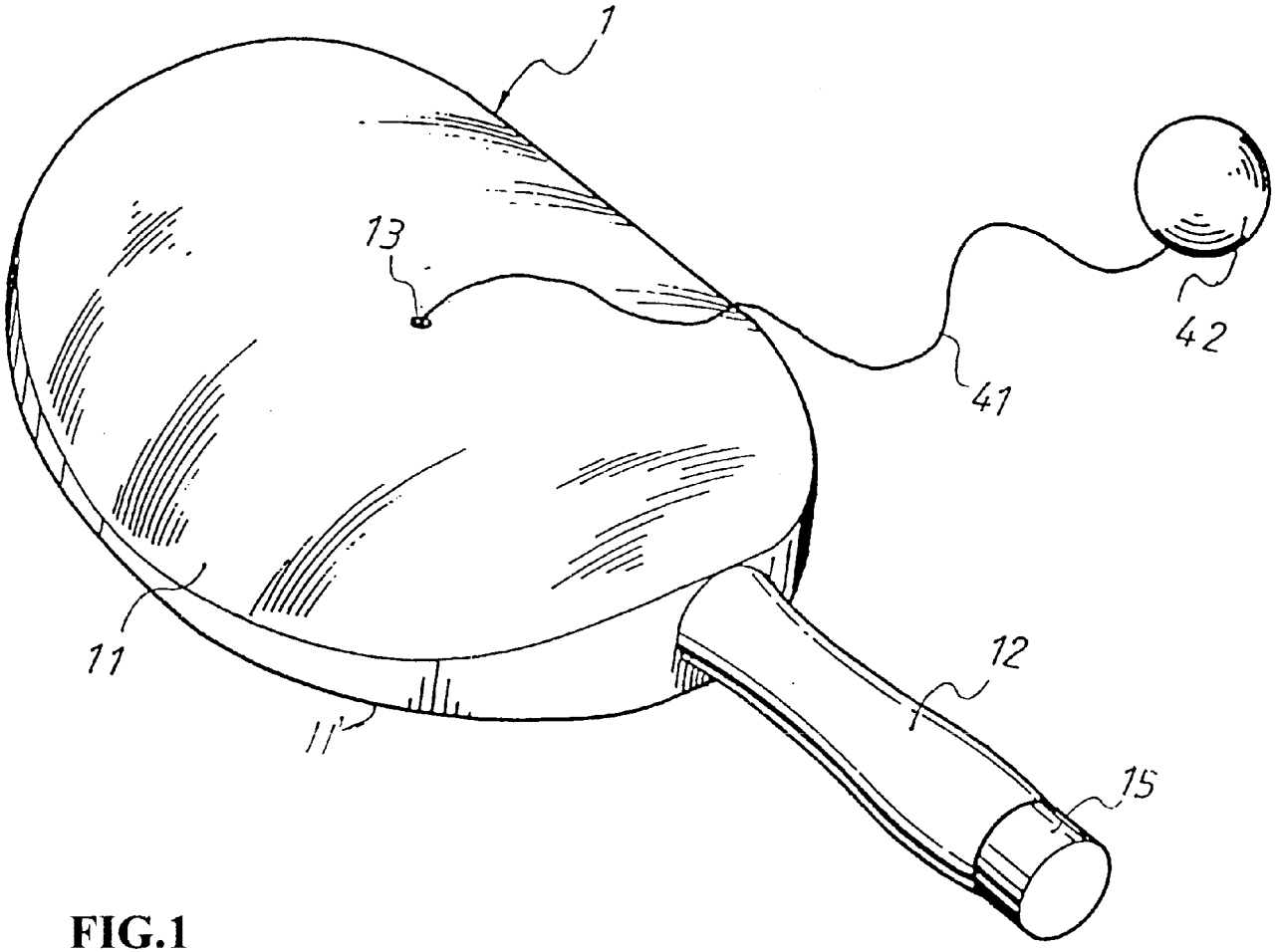
FIG.1 PRIOR ART
FIG. 1 is a perspective view to show the ball game set of the present invention.
Figure 2:
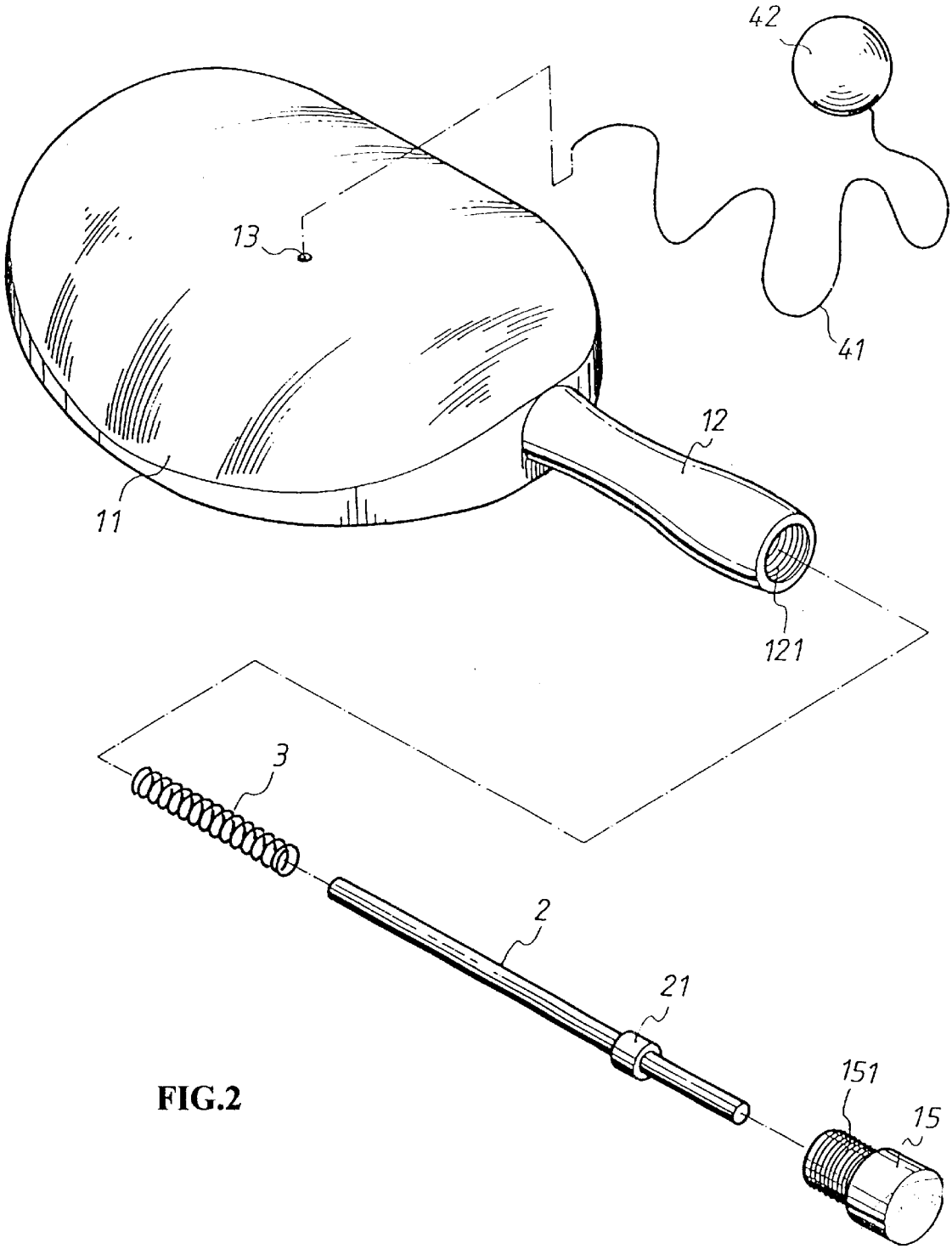
FIG. 2 is an exploded view to show the ball game set of the present invention.
Figure 3:
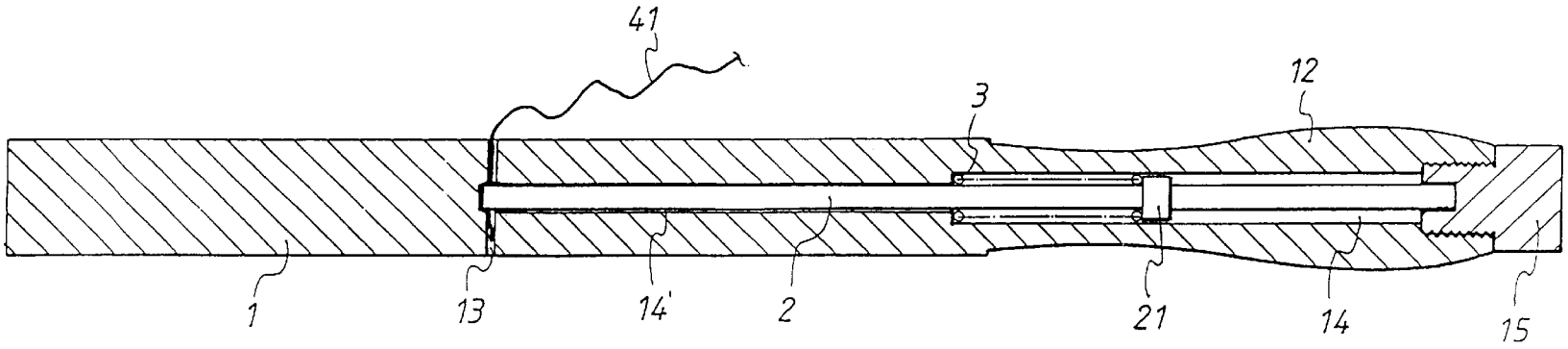
FIG. 3 is a cross sectional view to show the rod is pulled and the flexible cable is not yet inserted in the hole.

Referring to FIGS. 1, 2 and 3, the ball game set of the present invention comprises a racket having a head 1 and a handle 12 which is connected to the head 1. The head 1 has a flat face 11' and a curve face 11. A first passage 14 is defined through the handle 12 and a threaded inner periphery 121 is defined at a distal end of the handle 12 in the first passage 14. A second passage 14' is defined in the head 1 and co-axially communicates with the first passage 14. The second passage 14' is smaller than the first passage 14 so as to form a shoulder at the conjunction of the first passage 14 and the second passage 14'. A hole 13 is defined through the two faces 11, 11' of the head 1 and communicates with the second passage 14'.

A rod 2 is inserted in the first passage 14 and the second passage 14'. A flange 21 extends radially outward from the rod 2 and a spring 3 is mounted to the rod 2 and biased between the flange 21 and the shoulder.

Figure 4:
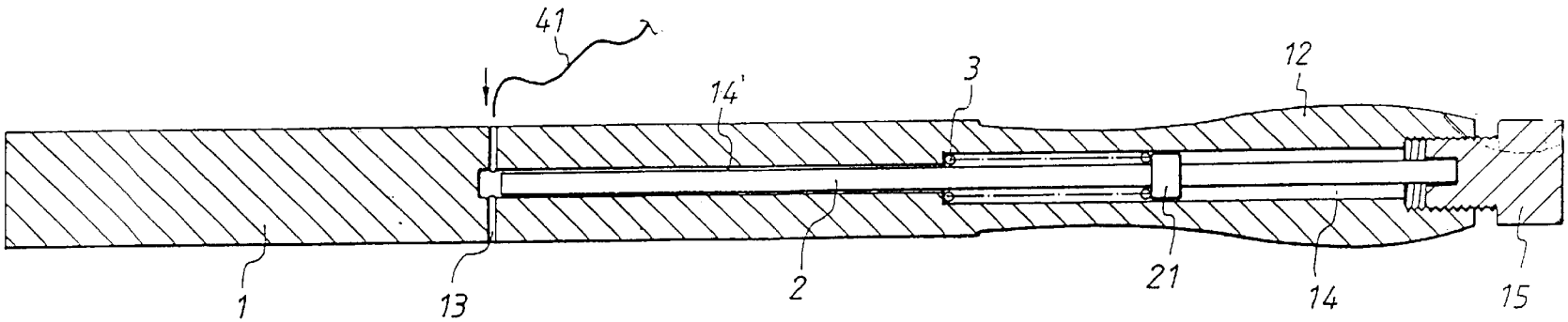
FIG. 4 is a cross sectional view to show the rod is released and the flexible cable is inserted in the hole and positioned by the rod.

An end cap 15 has a threaded shank 151 which is engaged with the threaded inner periphery 121. An end of the rod 2 is secured to the end cap 15. The rod 2 is pulled away from the hole 13 by pulling the end cap 15 as shown in FIG. 13 and a first end of a flexible cable 41 is then inserted in the hole 13 as shown in FIG. 4. The rod 2 is then released and the spring 3 pushes the rod 2 to let the other end of the rod 2 press the first end of the flexible cable 41. A bouncing ball 42 is connected to a second end of the flexible cable 41.

Figure 5:
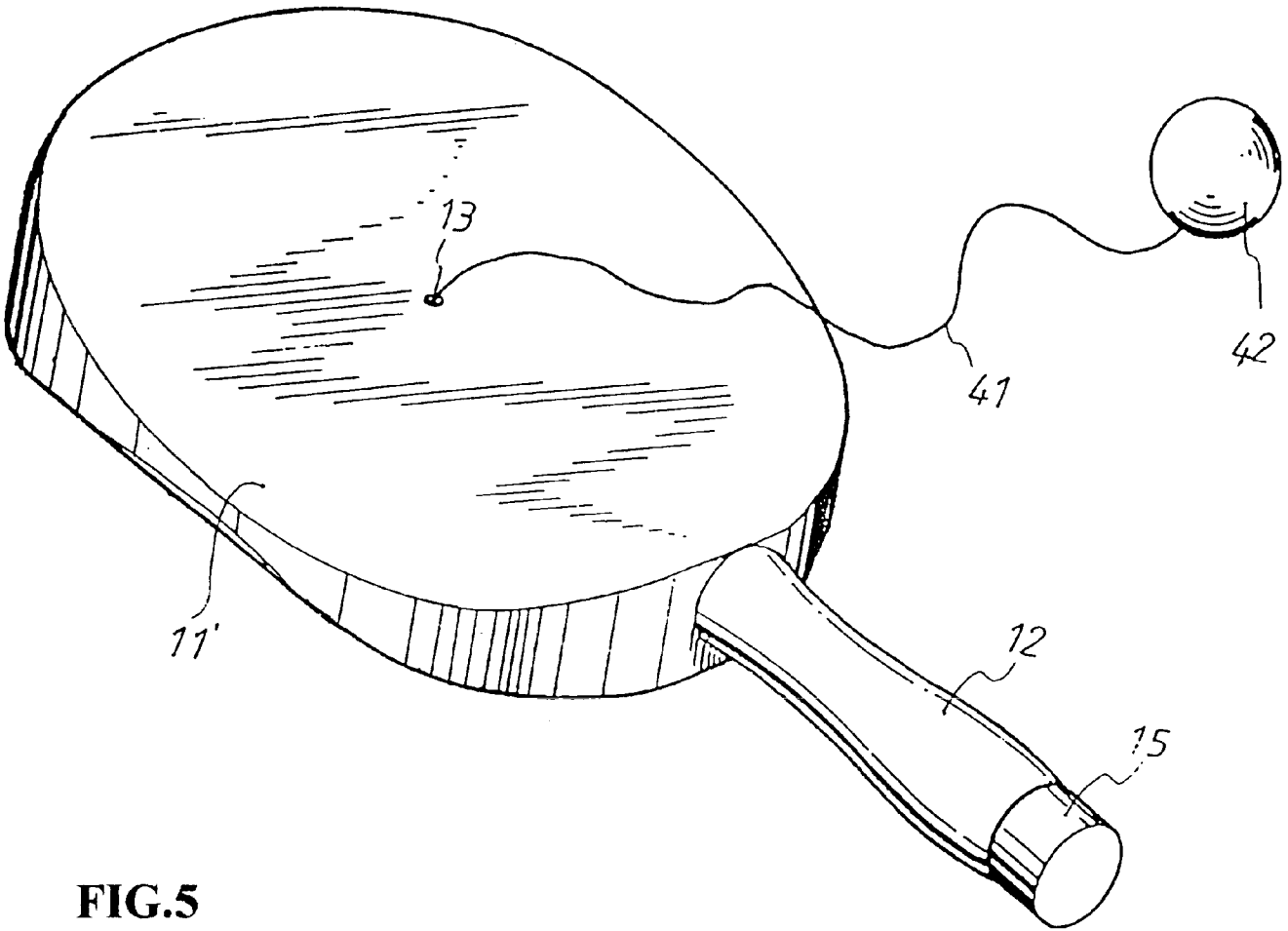
FIG. 5 is a perspective view to show the ball game set of the present invention wherein the flexible cable extends from the curve face of the racket.

The flexible cable 41 is easily to be replaced and secured in the hole 13 in either the flat face 11' or the curve face 11 as shown in FIG. 5. Therefore, the player can enjoy the ball game set.

While we have shown and described the embodiment in accordance with the present invention, it should be clear to those skilled in the art that further embodiments may be made without departing from the scope of the present invention.

What is claimed is:

1. A ball game set comprising:

a racket having a head and a handle which is connected to the head, a first passage defined through the handle and a threaded inner periphery defined at a distal end of the handle in the first passage, a second passage defined in the head and co-axially communicating with the first passage, the second passage being smaller than the first passage so as to form a shoulder at the conjunction of the first passage and the second passage, a hole defined through two faces of the head and communicating with the second passage;

a rod inserted in the first passage and the second passage, a flange extending radially outward from the rod, a spring mounted to the rod and being biased between the flange and the shoulder, an end cap engaged with the threaded inner periphery and secured to an end of the rod, and a flexible cable having a first end thereof inserted in the hole and a bouncing ball connected to a second end of the flexible cable, the other end of the rod pressing the first end of the flexible cable.

2. The ball game set as claimed in claim 1, wherein the head has a flat face and a curve face.

* * * * *